US008191502B1

(12) United States Patent
Jackson

(10) Patent No.: US 8,191,502 B1
(45) Date of Patent: Jun. 5, 2012

(54) ADJUSTABLE PROTECTIVE PAINT SHIELD

(76) Inventor: Anthony A. Jackson, Chicago, IL (US)

( * ) Notice: Subject to any disclaimer, the term of this patent is extended or adjusted under 35 U.S.C. 154(b) by 1037 days.

(21) Appl. No.: 12/132,369

(22) Filed: Jun. 3, 2008

(51) Int. Cl.
*B05C 13/00* (2006.01)
*B05C 11/11* (2006.01)
*B05D 1/32* (2006.01)

(52) U.S. Cl. ..... 118/504; 118/500; 118/505; 427/282

(58) Field of Classification Search ..... 118/500, 118/504, 505; 427/282
See application file for complete search history.

(56) References Cited

U.S. PATENT DOCUMENTS 2,453,863 A * 11/1948 Salisbury ..... 269/101
2,698,003 A 12/1954 Bullock
3,422,798 A 1/1969 Pine
3,565,038 A * 2/1971 Van Barriger ..... 118/504
4,258,654 A 3/1981 Ivankovich
4,280,444 A * 7/1981 Jones ..... 118/504
4,325,323 A * 4/1982 Rioux ..... 118/504
5,056,458 A * 10/1991 Askeland ..... 118/505
6,085,985 A * 7/2000 LaSelva ..... 237/79

* cited by examiner

*Primary Examiner* — Dah-Wei Yuan
*Assistant Examiner* — Charles Capozzi

(57) ABSTRACT

A tool used for covering or shielding a length of baseboard, trim or molding that is connected to a wall being painted. The adjustable protective paint shield has a fixed length center section from which are adapted two telescopic inner sections that extend to a desired length in order to cover or shield varying lengths of baseboard or trim. Each section has a general appearance of an elongated inverted L-shape. The center section has a plurality of pivotally affixed legs used in securing the shield in an upright position. The legs have an outwardly arched shape. The ached shape allows the bottom of the leg to sit securely flat against a floor while supporting the adjustable paint protection shield upright and tightly against a section of baseboard or trim being covered.

5 Claims, 3 Drawing Sheets

ADJUSTABLE PROTECTIVE PAINT SHIELD

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention relates to painting accessories and, more specifically, to a adjustable protective paint shield which provides a cover for baseboard trim when painting walls. The adjustable protective paint shield also provides a means of increasing or decreasing the size of the shielded area by extending outwardly two internally held shields.

BACKGROUND OF THE INVENTION

Prior art paint shields offer various devices for masking trim. However, prior art devices leave much to be desired in the securing the shield over the trim thereby failing to adequately protect the trim from paint. When painting interior or exterior walls one is confronted with the time consuming task of masking and covering baseboards or moldings, creating a defined line between the baseboard and wall, and the clean up. The present invention helps a painter to reduce time and effort spent dealing with the foregoing problems. The adjustable protective paint shield is a three-piece telescopic shield used for covering baseboard, trim or moldings that are attached to walls being painted. The design of the present shield allows a painter to simply press the shield against the baseboard to be covered, extend the legs and start painting. No time spent masking, no time spent edging, no time spent cleaning up soiled materials. The present shield allows for a worry-free painting job. With the simplicity in design, even the do-it-yourself painter, can have a convenient, timesaving, durable, clean painting experience.

SUMMARY OF THE INVENTION

The present adjustable protective paint shield is a three-piece telescopic shield. The shield may be constructed of aluminum or other lightweight rigid material. The present adjustable protective paint shield covers a length of baseboard trim or molding when painting a wall. The present invention can be constructed in several different lengths, for example, in 2-foot, 4-foot, 6-foot, and 8-foot lengths. These varying sizes help to cover multiple lengths of trim. The present shield allows the maximum length to be increased up to twice its original length. For example, a two-foot shield is extendable to four feet in length, while a four-foot shield is extendable to a length of eight feet. These increases to length are accomplished by extending outwardly two inner sections of the shield whose individual length is half the length of the outer section of the shield. The inner sections are of slightly smaller dimensions than the outer section. This smaller dimension gives the inner section the ability to be stored within the outer section. The inner sections are attached to the outer section by means of a cylindrical channel. This channel allows the inner sections to slide outwardly and to be retracted. The present invention has a plurality of legs pivotally affixed to the outside surface of the outer section. The legs are curved inwardly toward the trim or baseboard, which help to support the shield and secure it tightly against the baseboard or trim being covered. These hinged legs also serve as handles to carry and adjust the shield.

An object of the present adjustable protective paint shield is to provide a self-supporting paint shield to securely cover trim or baseboard during painting projects.

Another object of the present adjustable protective paint shield is to be used as a hand-held device to cover trim such as window or door casings and jams.

Yet another object of the present adjustable protective paint shield is to reduce the cost of masking materials associated with covering the baseboard or trim when painting walls such as tape, plastic, and paper.

Still another object of the present adjustable protective paint shield is to reduce the cost of labor and/or time associated with covering the trim or baseboard engaged in a painting project.

Even another object of the present adjustable protective paint shield is to reduce physical strain associated with masking or covering of trim when engaged in painting project.

Still even another object of the present adjustable protective paint shield is the prevention of messes both during the painting process and during the clean up afterwards, thereby reducing the mess associated with clean up upon completion of the project due to lack of masking materials used, further reducing waste.

As such, the general purpose of the adjustable protective paint shield which has all of the advantages of the prior art mentioned heretofore and many novel features that result in an improved adjustable protective paint shield which is not anticipated, rendered obvious, suggested, or even implied by the prior art, either alone or in combination thereof.

Thus has been broadly outlined the more important features of the improved adjustable protective paint shield so that the detailed description thereof that follows may be better understood and in order that the present contribution to the art may be better appreciated.

These together with additional objects, features and advantages of the improved adjustable protective paint shield will be readily apparent to those of ordinary skill in the art upon reading the following detailed description of presently preferred, but nonetheless illustrative, embodiments of the improved adjustable protective paint shield when taken in conjunction with the accompanying drawings. In this respect, before explaining the current embodiments of the improved adjustable protective paint shield in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the improved adjustable protective paint shield. It is therefore important that the claims be regarded as including such equivalent constructions insofar as they do not depart from the spirit and scope of the present invention.

Objects of the improved adjustable protective paint shield, along with various novel features that characterize the invention are particularly pointed out in the claims forming a part of this disclosure. For better understanding of the improved adjustable protective paint shield, its operating advantages and specific objects attained by its uses, refer to the accompanying drawings and description.

DETAILED DESCRIPTION OF THE DRAWINGS

Figures 1, 2:
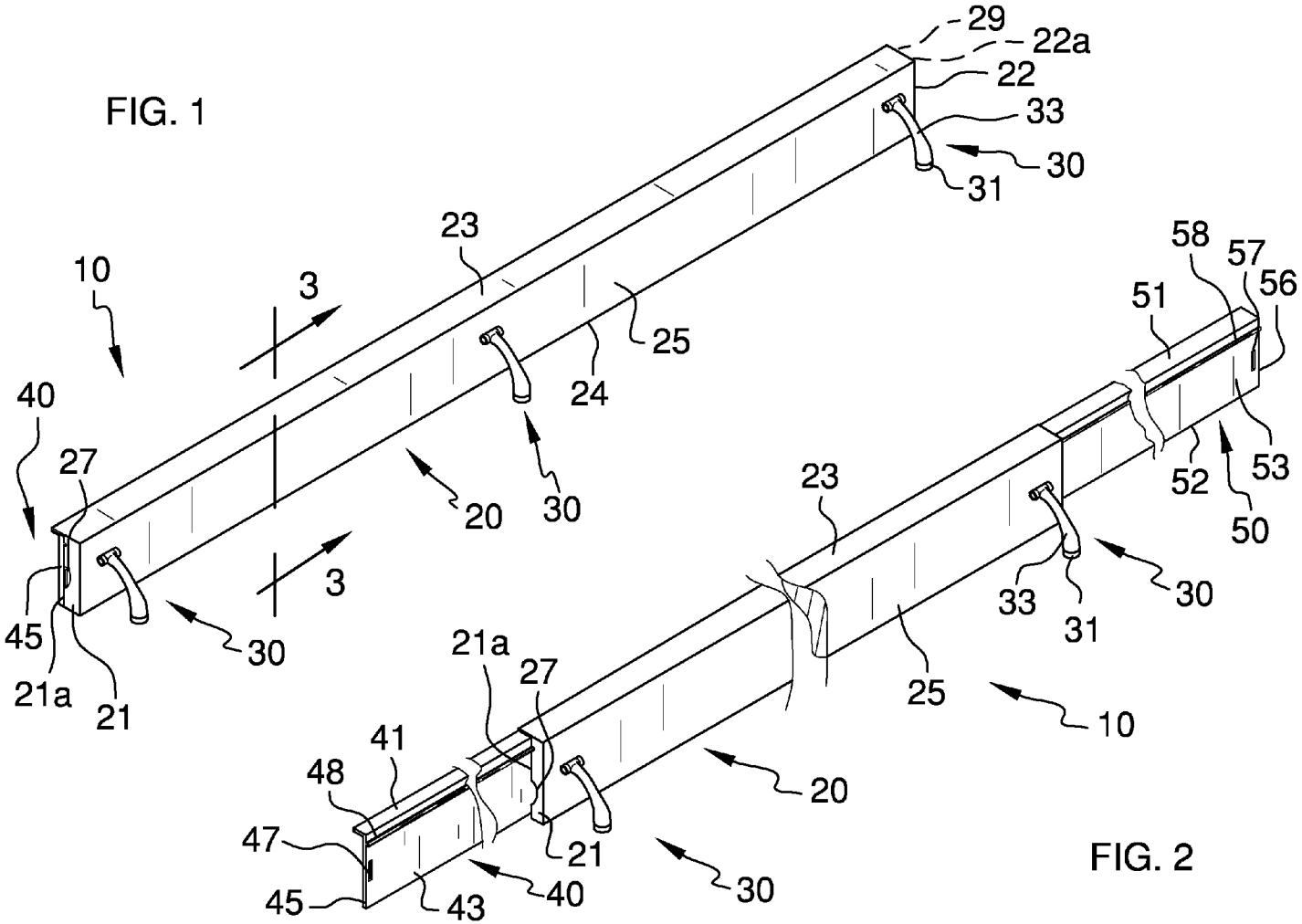
FIG. 1 is a perspective view.
FIG. 2 is a fragmentary perspective view in an extended position.
Figure 3:
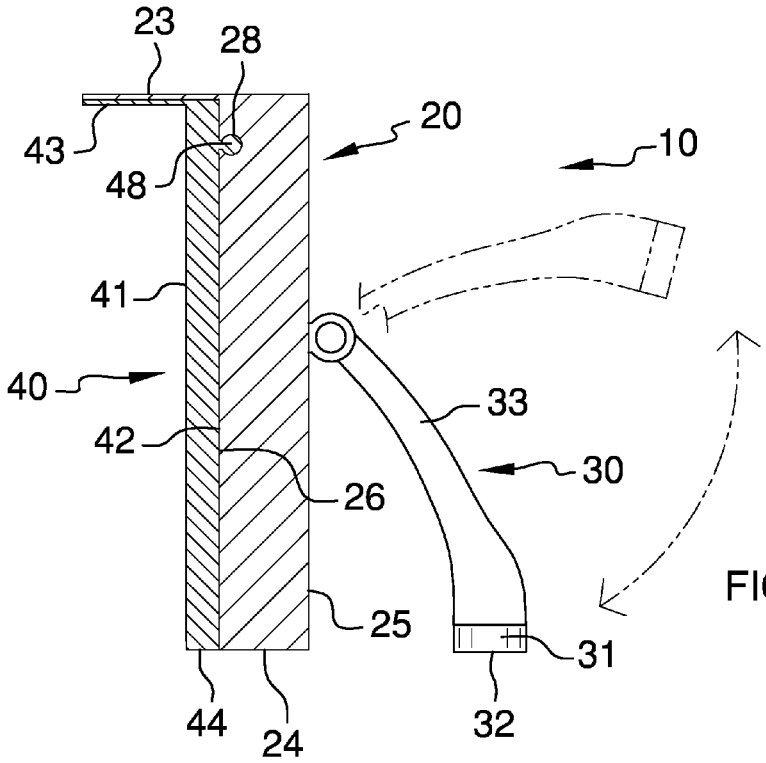
FIG. 3 is a cross-section view taken along line 3-3 of FIG. 1, illustrating movement of a mounting leg.
Figure 4:
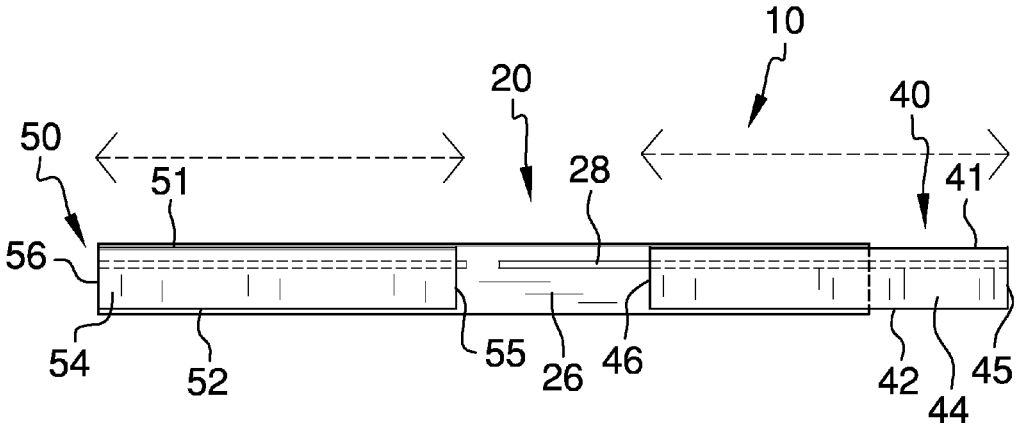
FIG. 4 is a rear elevation view illustrating telescopic movement.

With reference now to the drawings, and in particular FIGS. 1 through 5 thereof, examples of the employing the principles and concepts of the present adjustable protective paint shield, generally designated by the reference number 10, will be described.

Referring to FIGS. 1 through 5, the present adjustable protective paint shield 10 comprises in combination of a center section 20, an inner left section 40 and an inner right section 50.

Figure 5:
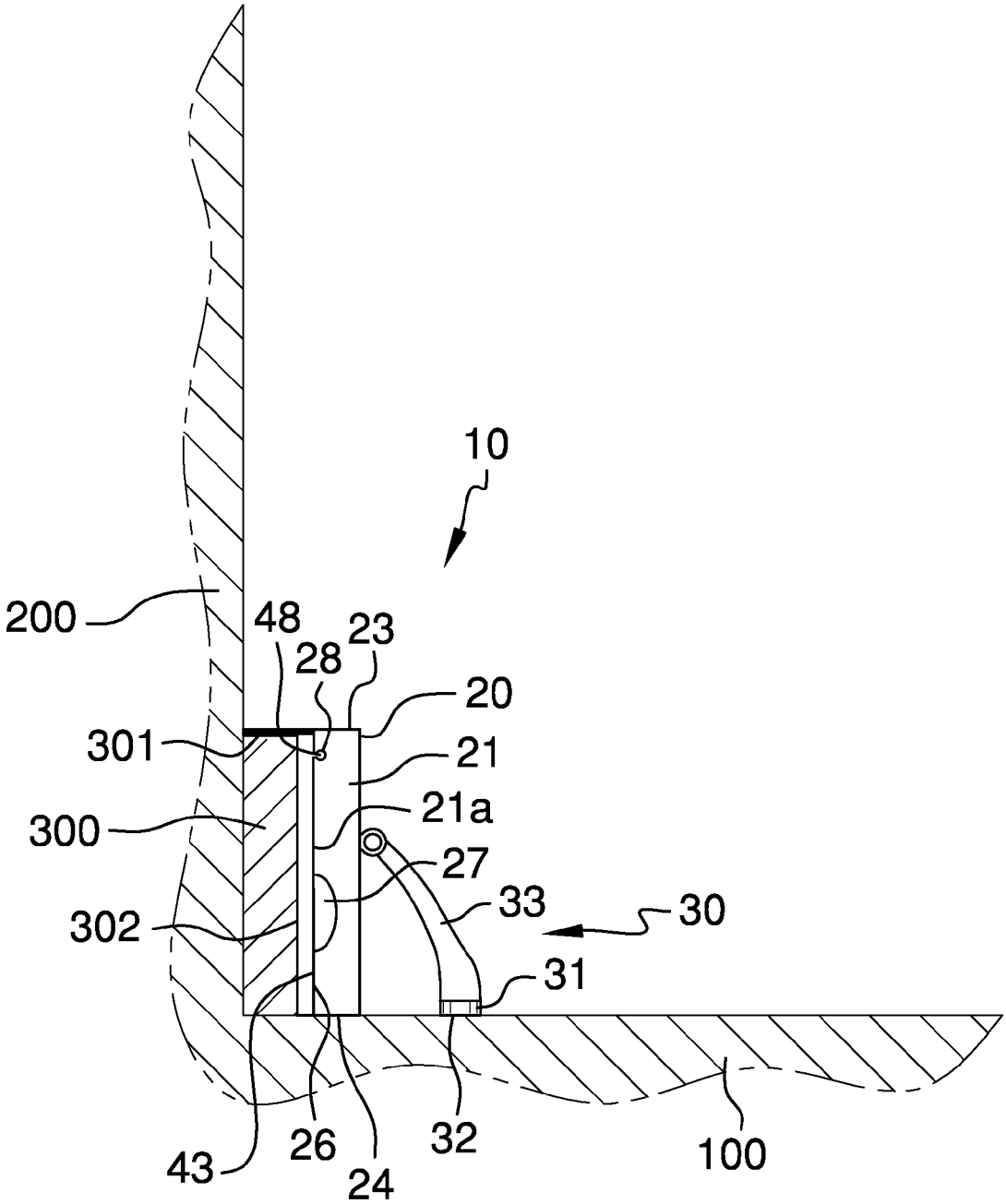
FIG. 5 is a left elevation in-use view illustrating the present adjustable protective paint shield secured over a baseboard.

The center section 20 having a left side 21, a right side 22, a elongated topside 23, an elongated bottom side 24, an rectangular outer surface 25, and a rectangular inner surface 26. The topside 23 has a wider dimension than the bottom side 24, giving the center surface 20 an inverted L-shaped appearance. As shown in FIG. 5 in an exemplary environment, the topside 23 is adapted to cover the top edge of a baseboard or molding 301, wherein the baseboard or molding 300 is attached to a vertical wall 200.

Pluralities of mounting legs 30 are pivotally affixed to the outer surface 25 of center section 20. The mounting legs 30 have adapted rubber footpads 32, which have bottom sides 32. The mounting legs 30 have an outwardly arched main leg body 33 having a given length. When a mounting leg 30 is downwardly engaged, the arched main leg body 33's shape and length allows the bottom side 32 of a rubber footpad 31 to rest flat against a floor surface 100 about three inches away from the outer surface 25 of the center section 20. The up and down pivoting motion of a mounting leg 30 is adapted to tightly secure the adjustable protective paint shield 10 over the baseboard 300.

The inner surface 26 of the center section 20 has a lateral cylindrical channel 28 that runs continuously from the left side 21 to the right side 22. This channel 28 is adapted to receive a telescopic left inner section 40 and a telescopic right inner section 50.

The inner left section 40 has an elongated topside 41, a elongated bottom edge 42, a rectangular outer surface 43, a rectangular inner surface 44, a left edge 45, a right edge 46 and a thumb notch 47. The elongated topside 41 has a wider dimension than the elongated bottom edge 42 giving the inner left section 40 an inverted L-shape. The outer surface 43 has adapted to it a lateral cylindrical bead 48. The lateral bead 48 is adapted to slide within the lateral channel 28 on the inner surface 26 of the center section 20. The interconnection of channel 28 and bead 48 are to give a telescoping movement of the inner left section 40. The inner left section 40 has an overall length of one half of the length and an overall dimension slightly smaller than that of the center section 20. The bead 48 along with the slightly smaller dimensions gives the inner left section 40 the ability to be telescoped outwardly and be retracted inwardly for storage within center section 20. The rectangular inner surface 44 is adapted to fit against the outer surface 302 of the baseboard 300.

The inner right section 50 has an elongated topside 51, a elongated bottom edge 52, a rectangular outer surface 53, a rectangular inner surface 54, a left edge 55, a right edge 56 and a thumb notch 57. The elongated topside 51 has a wider dimension than the elongated bottom edge 52 giving the inner right section 50 an inverted L-shape. The outer rectangular surface 53 has adapted to it a lateral cylindrical bead 58. The lateral bead 58 is adapted to slide within the lateral channel 28 on the inner surface 26 of the outer section 20. The interconnection of channel 28 and bead 58 are to give a telescoping movement of the inner right section 50. The inner right section 50 has an overall length of one half of the length and an overall dimension slightly smaller than that of the center section 20. The bead 58 along with the slightly smaller dimensions gives the inner right section 50 the ability to be telescoped outwardly and be retracted inwardly for storage within center section 20. The inner surface 54 is adapted to fit against the outer surface 302 of the baseboard 300.

Left side 21 has adapted a semi-circular indention 27 located along an inner corner 21*a*. The indention 27 is adapted to expose a thumbnail slot 47 of the outer elongated surface 43 of the inner left section 40. The exposed slot 47 is adapted as a means to engage the inner left section 40 into a desired telescopic length.

Right side 22 has adapted a similar semi-circular indention (not shown) located along an inner corner (not shown). The indention 29 is adapted to expose a thumbnail slot 57 of the outer elongated surface 53 of the inner right section 50. The exposed slot 57 is adapted as a means to engage the inner right section 50 into a desired telescopic length.

With respect to the above description then, it is to be realized that the optimum dimensional relationships for the parts of the adjustable protective paint shield, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An adjustable protective paint shield comprising:

a center section having an elongated topside, an elongated bottom side, a left side, a right side, a rectangular inner surface and a rectangular outer surface, wherein said elongated topside has a dimension that is about twice the width of said elongated bottom side, further, wherein the dimension extends beyond the body of said center section, the width combined with the remaining dimensions of center section creates an inverted L-shape wherein the L-shape covers the top side of a baseboard or molding, a cylindrical track formed within said inner elongated surface of said center section, wherein said track continuously runs laterally from said left side to said right side of said center section, thus said track allows a means of connecting a inner left section and a inner right section having slightly smaller dimensions than said center section, a plurality of pivotally affixed mounting legs attached to the outer surface of the center section wherein the legs secure and erect said adjustable protective paint shield against a length of baseboard or trim, wherein said mounting legs further comprise an outwardly arched main leg body, a rubber foot pad and a foot pad bottom side, said mounting legs pivot downwardly to contact a floor or floor surface allowing for the secure and upright mounting of said adjustable protective paint shield, an inner left section comprising of a elongated topside, a elongated bottom edge, a left edge, a right edge, a inner rectangular surface and a outer rectangular surface, wherein said elongated topside has a dimension that is about twice the width of said elongated bottom side, further, wherein the dimension extends beyond the body of said center section, the width combined with the remaining dimensions of center section creates an inverted L-shape wherein the L-shape covers the top side of a baseboard or molding, a laterally running cylindrical bead connecting said inner left section to said center section, wherein the connection of said bead and said track allow said inner left section to telescope outwardly to a desired length for shielding purposes and be retracted inwardly for storage, a thumbnail indention located at the end of the left outer rectangular surface, a semicircular indention located on the left interior corner of the center section, wherein the indentation exposes the thumbnail indention an inner right section comprising of a elongated topside, a elongated bottom edge, a left edge, a right edge, a inner rectangular surface and a outer rectangular surface, wherein said elongated topside has a dimension that is about twice the width of said elongated bottom side, further, wherein the dimension extends beyond the body of said center section, the width combined with the remaining dimensions of center section creates an inverted L-shape wherein the L-shape covers the top side of a baseboard or molding, a laterally running cylindrical bead connecting said inner right section to said center section, wherein the connection of said bead and said track allow said inner right section to telescope outwardly to a desired length for shielding purposes and be retracted inwardly for storage, a thumbnail indention located at the end of the right outer rectangular surface, a semicircular indention located on the right interior corner of the center section, wherein the indentation exposes the thumbnail indention.

2. An adjustable protective paint shield of claim 1 wherein the adjustable protective paint shield is a length of at least two feet, a height of a least two inches a overall width of no less than one inch.

3. An adjustable protective paint shield of claim 1 wherein the adjustable protective paint shield is made of aluminum.

4. An adjustable protective paint shield of claim 1 wherein the adjustable protective paint shield is made of plastic.

5. An adjustable protective paint shield of claim 1 wherein the adjustable protective paint shield is made of composite material.

* * * * *